United States Patent [19]

Palmer

[11] Patent Number: 4,476,619

[45] Date of Patent: Oct. 16, 1984

[54] METHOD AND APPARATUS FOR INSERTING BAGS ONTO CARDS

[75] Inventor: Charles E. Palmer, Somers, Conn.

[73] Assignee: Palmer Systems, Incorporated, Somers, Conn.

[21] Appl. No.: 388,712

[22] Filed: Jun. 15, 1982

[51] Int. Cl.[3] ..... B23P 11/00; B23P 21/00; B21D 39/03; B23Q 7/10

[52] U.S. Cl. ..... 29/429; 29/513; 29/788; 29/818; 206/466; 53/137; 53/415

[58] Field of Search ..... 29/429, 407, 771, 788, 29/509, 283.5, 513, 818; 53/416, 137, 415; 206/466, 482

[56] References Cited

U.S. PATENT DOCUMENTS

| | | | |
|---|---|---|---|
| 2,030,996 | 2/1936 | Lustig | 206/466 |
| 2,147,470 | 2/1939 | Tate | 206/482 X |
| 2,656,917 | 10/1953 | Hollis | 206/482 X |
| 2,656,918 | 10/1953 | Hollis | 206/482 X |
| 2,978,706 | 4/1961 | Moberg | 29/818 |
| 3,182,386 | 5/1965 | McGee | 29/818 |
| 3,415,035 | 12/1968 | Wickersheim | 29/771 X |
| 3,465,411 | 9/1969 | Mahnken | 29/407 |
| 4,214,661 | 7/1980 | Turetsky et al. | 206/466 |
| 4,319,684 | 3/1982 | Backman et al. | 53/396 X |

FOREIGN PATENT DOCUMENTS

| | | | |
|---|---|---|---|
| 1250656 | 10/1971 | United Kingdom . | |
| 1492741 | 11/1977 | United Kingdom | 29/513 |
| 1492742 | 11/1977 | United Kingdom . | |
| 1492743 | 11/1977 | United Kingdom . | |
| 2041743A | 8/1979 | United Kingdom . | |
| 2055741A | 7/1980 | United Kingdom | 29/429 |

*Primary Examiner*—Charlie T. Moon

[57] ABSTRACT

A mechanism automatically mounts end-flanged bags upon a display card disposed in an upright position, with the bags suspended, prior to insertion, in such a manner as to promote movement of the contents away from the flange that is to be engaged by the locking tabs. It includes means for forcing a locking tab of the card out of its plane, for inserting the flange of the bag into the slot formed behind the tab, and for returning the tab through the plane of the card to effect the interlock.

25 Claims, 5 Drawing Figures

METHOD AND APPARATUS FOR INSERTING BAGS ONTO CARDS

BACKGROUND OF THE INVENTION

Point-of-sale display cards are widely utilized as a means for dispensing small bags or packets of snack foods and other products to the customer. While such cards may assume any of several forms, the product bags of are normally either stapled to the card, or the card itself is formed with integral gripping means by which the bags can be disengageably mounted. Typical of the latter are the constructions shown in U.S. Pat. Nos. 2,030,996 to Lustig and 2,656,918 to Hollis; United Kingdom patent specification Nos. 1,250,656, 1,487,365, 1,492,741, 1,492,742, 1,492,743, and 1,600,047; and United Kingdom patent application Nos. GB 2 041 743A and GB 2 055 741A, all of the foregoing United Kingdom patent properties being in the name of Allen Davies & Company. In copending application Ser. No. 385,881, entitled CARD FOR MOUNTING BAGS AND THE LIKE, filed on June 7, 1982, now U.S. Pat. No. 4,422,552, issued Dec. 27, 1983 and of common assignment herewith, a novel display card is disclosed, which has a matched pair of locking tabs to provide two-point, corner support for the product bags.

While it is generally feasible to mount the bags upon all such tab-formed product display cards by manually loading them into the slots behind the tabs, such an approach is obviously cumbersome, time-consuming and far from ideal. Despite this, and despite the prior recognition of the desirability of carrying out the product-loading operations by automatic mechanical means, there appears to be scant disclosure in the art of machinery and mechanisms by which such operations can be effected.

In the above-mentioned United Kingdom patent application No. 2 055 741 A, apparatus for attaching articles to support cards is described, wherein the cards are carried on a conveyor about a roller to the package-loading station. When properly positioned, a deflector member displaces the tongue of the gripping structure, permitting the end flange of the product package to enter therebehind, following which a presser member pushes the tongue back through the body of the card to grasp the inserted portion. This apparatus suffers from several serious deficiencies, paramount amongst which is the fact that the packets are loaded upside-down, with the product filling the area directly adjacent the flange that is to be inserted. This limits the level of gripping force that can be developed, and inhibits facile and effective loading.

A device for assisting the insertion of bags behind tongues of a display card is disclosed in United Kingdom patent No. 1 492 741, also mentioned above. Apparatus for use in attaching product bags to a supporting strip, by stapling, adhesive bonding or punching, is taught in Mahnken U.S. Pat. No. 3,465,411. Neither of these patents, however, addresses the need for an automatic mechanism for mounting products bags upon display cards.

Accordingly, it is a primary object of the present invention to provide a novel mechanism by which product bags can be mounted automatically upon a display card, rapidly and in a highly effective and reliable manner, with the bags being arranged in a multiple column and row pattern, if so desired.

It is a more specific object of the invention to provide such a novel mechanism wherein the bag is so disposed, prior to the loading operation, as to promote movement of its contents away from the flange to be engaged by the card, thereby contributing substantially to the level of support ultimately provided, and to the effectiveness and facility of loading.

Another object of the invention is to provide a mechanism having the foregoing features and advantages, which is of relatively uncomplicated design, and is especially well-adapted for use in an integrated packaging system.

Yet an additional object of the invention is to provide a novel method for the mounting of product bags upon a display card, which method is rapid, facile, highly effective, and reliable.

SUMMARY OF THE INVENTION

It has now been found that certain of the foregoing and related objects of the invention are readily attained in a mechanism, which comprises the combination of (a) means for supporting the display card, (b) tab displacing means, (c) bag carrying means, and (d) tab return means, all to be described more specifically below. Perhaps it should be pointed out here, however, that the display card for which the mechanism is designed is characterized by a locking tab arrangement comprised of at least one lower locking tab that is displaceable from the plane of the card about a lower hinge portion thereof, and an upper edge portion configured to cooperate with a lower edge portion of an adjacent section of the card to engage the bag flange therebetween. The card supporting means is adapted to dispose the card in a generally upright position, and the displacing means pivots the tab about its hinge portion to displace it from the plane of the card outwardly of the forward face thereof. Preliminary to loading, the carrying means disposes the bag at a location adjacent the same face, with the bag in a generally horizontal position, and means associated therewith is adapted to grip the bag with its flange folded downwardly. The carrying means is supported for movement, at its location adjacent the forward face of the supported card, as will effect insertion of the flange of the bag into the slot formed behind the displaced tab. Thereafter, the return means forces the tab, with the folded portion of the bag carried thereupon, back through the plane of the card, to partially dispose the folded bag portion behind the card and thereby effect engagement of the bag thereon.

In the preferred embodiments of the apparatus, the card supporting means includes a conveyor having engagement members thereon for holding the card in a fixed position relative thereto, and generally it will also include drive means for the conveyor. Such drive means will be adapted for actuation to index the card to a multiplicity of positions relative to the carrying means and the tab displacing and return means, to thereby position it, in stepwise fashion, for mounting of a multiplicity of bags arranged as a column thereon.

The tab displacing means desirably comprises a blade member disposed to contact the tab on the rearward face of the card, and generally the blade member will be mounted for pivotable movement in a arc that extends through the plane thereof; it will normally be of a curved configuration. The mechanism will, in such instance, additionally include drive means, adapted for actuation to first pivot the blade member upwardly through its arc and into contact with the rearward surface of the tab adjacent the hinge portion thereof, thereafter through the card plane to force the tab to a forwardly displaced position and to define a slot therebehind, and finally to pivot the blade member downwardly to withdraw it therefrom.

The return means of the mechanism will preferably comprise a staking member, disposed to contact the tab on the forward face of the card. Generally, such a staking member will also be mounted for pivotable movement in an arc extending through the plane of the card, and the mechanism will additionally include drive means adapted for actuation to pivot the staking member (usually through a downward arc) to an initial position in contact with the folded portion of the bag adjacent the upper edge portion of the tab, then to move it through the plane of the card, and finally to withdraw the staking member therefrom. The drive means should also be adapted to cause the staking member to dwell in its initial position, so as to temporarily hold the bag in assembly on the tab while the blade member is being withdrawn from the tab slot.

In the especially preferred embodiments of the mechanism, the carrier means will include a carriage mounted for reciprocal movement along a generally horizontal path, to and from the loading location adjacent the forward face of the card. The carriage will advantageously be supported for downward tipping at that location to effect flange insertion, in which instance the mechanism will additionally include means for achieving such movement of the carriage. The gripping means may be provided on the carriage itself, and it will most desirably be contoured to deform the flange of the bag upon engagement therewith, to inherently produce the necessary downwardly folded condition while gripping the bag. It will be particularly desirable for the gripping means to support the bag with its main body portion hanging at such an angle to horizontal as to promote movement of the bag contents away from the flange that is to be engaged within the card. The mechanism may also include conveyor means for delivering the bag to the carriage in a generally horizontal disposition, as well as means for shuttling the carriage along the path between the conveyor means and the card.

In addition, the mechanism may include a pinning member, disposed to contact the card at a location on the forward face thereof below the hinge portion of the tab. Such pinning means will normally have associated drive means for moving it between the contact position and a position withdrawn therefrom, which movement will occur in timed relationship to the movement of the tab-pivoting blade member, to assist in establishing and maintaining the displaced position of the tab. Finally, the mechanism will generally include means for furnishing the display cards to the supporting means thereof, which furnishing means will typically include a hopper for the containment of a stack of such cards, and means for withdrawing the cards individually and for delivering them, seriatim, to the supporting means.

Other objects of the invention are attained by the provision of a novel method for mounting end-flanged bags upon a display card. In accordance therewith, the following steps are effected automatically and in timed sequence: (1) disposing a display card in a generally upright position; (2) displacing a lower locking tab thereof forwardly from the plane of the card about its hinge portion, to form a slot therebehind; (3) carrying the bag to a position proximate the forward face of the card, with the main body portion thereof in a generally horizontal position and with the flange folded downwardly; (4) moving the bag to insert the flange into the slot behind the tab; and (5) forcing the tab, with the folded portion of the bag carried thereupon, back through the plane of the card to effect engagement by partially disposing the folded portion of the bag flange therebehind.

In the preferred embodiments of the method, the locking tab arrangement of the card will comprise a multiplicity of such tabs disposed in a column thereon, with the card being indexed to a multiplicity of positions, in stepwise fashion. Each tab will be displaced and returned in sequence, and the bags will be carried individually to the loading position, with the flange thereof inserted behind the tab to which it is presented, to thereby mount the bags in a column on the card. Generally, the method will include the additional step of downwardly folding the flange of the bag, which step will conveniently be effected substantially at the commencement of the bag carrying step. Most desirably, the carrying step will be performed with the bag suspended from its flange and with the main body portion thereof hanging downwardly, to promote movement of the contents away from the flange, the insertion thereof normally being effected with a downward tilting movement of the bag.

DETAILED DESCRIPTION OF THE ILLUSTRATED EMBODIMENT

Figure 1:
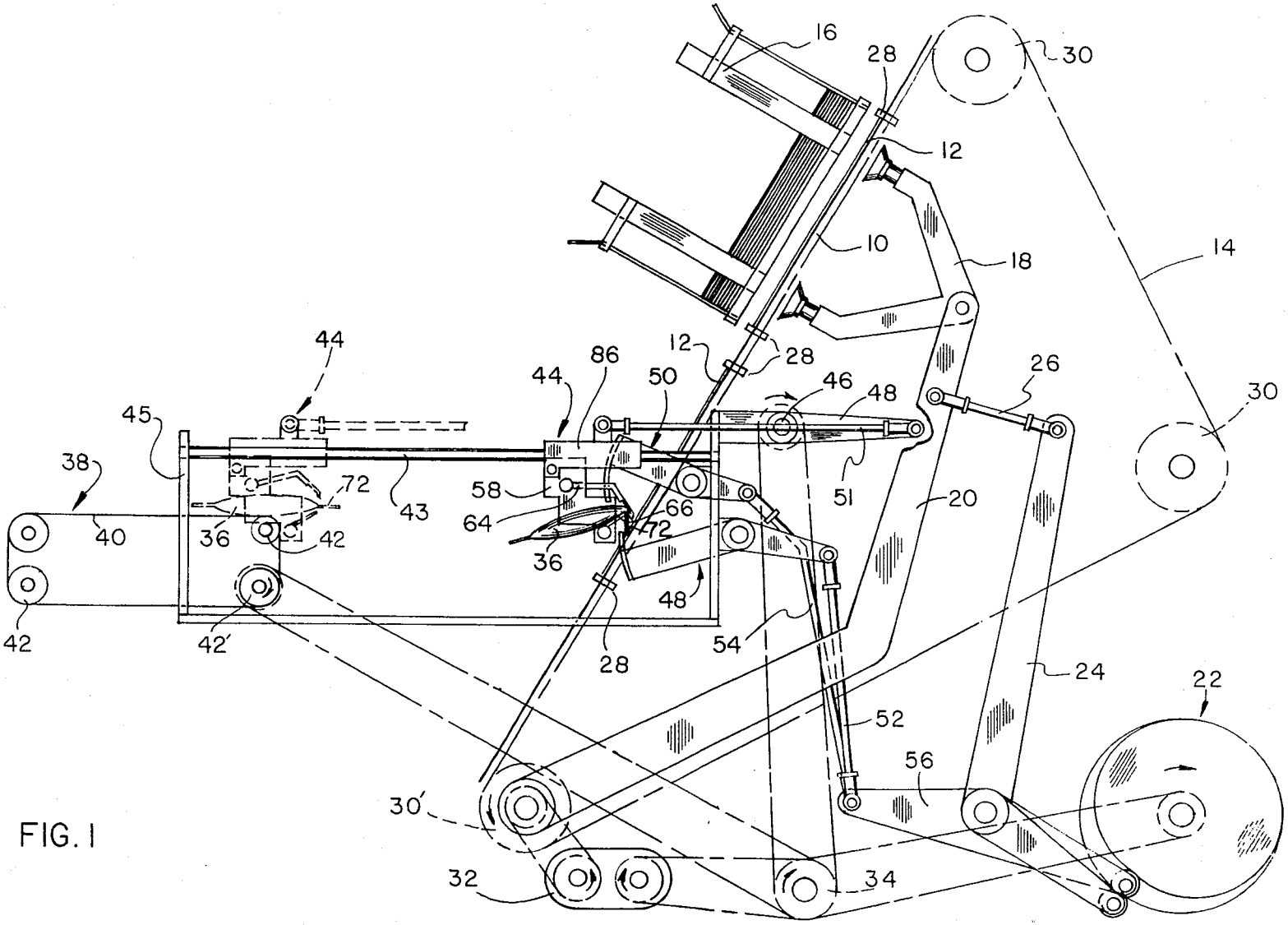
FIG. 1 is a schematic representation of a mechanism embodying the present invention.

Turning now in detail to FIG. 1 of the drawings, therein illustrated schmetically is a mechanism embodying the present invention. A pair of parallel, laterally spaced tracks 10 (only one of which is visible) define a path through the loading station of the mechanism, along which the individual product display cards 12 are transported by the chain conveyor 14. The cards are supplied from a stack which is contained within a hopper or magazine 16, being removed therefrom by the suction device 18, as required. The latter is supported at the upper end of a pivotably mounted lever arm 20 which, in turn, is actuated by one of the cams of a bank thereof, generally designated by the numeral 22, through a suitable operating arm 24 that is connected thereto by a rod 26. As will be appreciated, the suction device 18 withdraws the cards 12 individually from the bottom of the stack, and deposits them between the tracks 10, which may appropriately be formed with progressively inwardly turned edges to eventually secure the cards downwardly against the surface thereof. Lugs 28 are attached to the chain 14 in appropriately spaced positions to engage the top and bottom edges of the each card, to enable controlled movement of the cards through the loading station. The chain 14 is disposed about suitable pulleys 30,30', the latter being driven through a Geneva drive unit 32, which is capable of indexing the conveyor, and thereby the cards 12 carried thereby, to progressively lower positions, in stepwise fashion, and thereafter away from the station and onto a belt conveyor (not shown), for outfeed from the system. A main drive or prime mover 34 is coupled to the unit 32 and to the bank 22 of cam wheels, driving them as well as the other moving parts of the mechanism, as will be described in some detail hereinbelow.

Also included is a belt infeed arrangement, generally designated by the numeral 38, which is utilized to bring the product bags 36 into the loading mechanism, and which may consist of a set of timing belts 40 (only one of which is indicated) disposed about pulleys 42,42', the latter being driven, as shown. A carriage assembly, generally designated by the numeral 44, is mounted for reciprocal sliding movement upon a pair of horizontal bars 43 (only one of which is visible) which are, in turn, mounted on the frame 45. Movement of the carriage assembly 44 is motivated by the prime mover 34, and is actuated through the crank shaft 46, the operating arm 48, and the connecting rod 50, rotation of the crank shaft 46 imparting a shuttle movement to the carrier assembly 44. The fully withdrawn position, at which the bags 36 are picked up from the conveyor assembly 38, is shown in phantom line; the extended, loading position, adjacent the forward face of the card 12, is shown in full line.

FIG. 1 also illustrates the slot-opening blade member and the staking member, generally designated by the numerals 48 and 50, respectively. These are pivotably mounted, and are connected for actuation by appropriate cam wheels of the bank 22, through connecting rods 52, 54 and suitable lever arms 56 (only one of which is visible).

Figure 2:
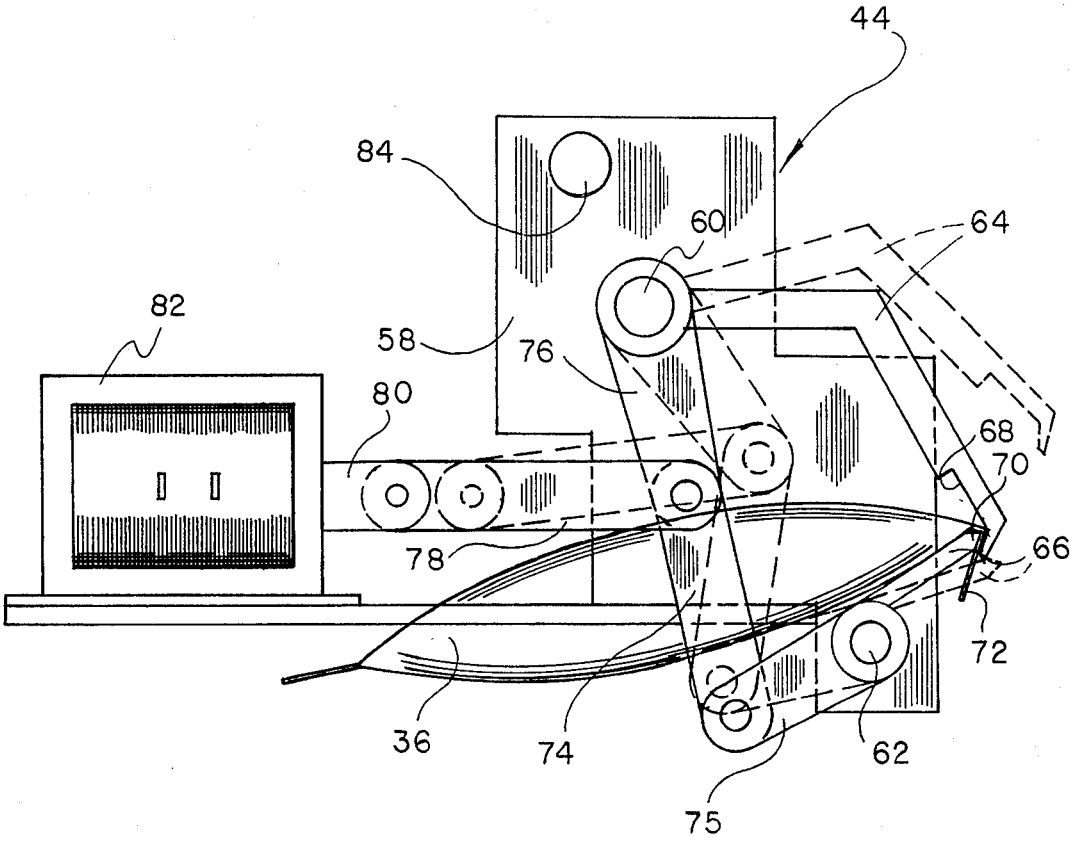
FIG. 2 is a schematic representation of the carriage utilized to grip the bags to be loaded onto the display card, and to carry them from the delivery conveyor to the card.

Turning now to FIG. 2, the carriage assembly 44, for gripping and transporting the bags 36 from the belt infeed conveyor arrangement 38 to the card loading location, is illustrated in greater detail. It consists of a pair of side plates 58 (only one of which is visible) between which are mounted shafts 60, 62, on which are carried upper and lower gripping jaws 64, 66, respectively. The forward end portion of the upper jaw 66 has a recess 68 formed therein, and the corresponding portion of the lower jaw 66 is formed with a rather sharply angled tip 70. Consequently, when the flange 72 at the forward end of the bag 36 is gripped between the jaws 66, 68, it is folded about the end 70 of the lower jaw 66, deflecting it downwardly to the proper angle for facile insertion behind the tab of the card locking arrangement, as will be described in detail hereinbelow. The jaws 66, 68 are connected to arms 74, 76, which are in turn pivotably engaged with a common linkage 78, connected to the operating shaft 80 of a solenoid 82. With the shaft retracted (in the full line representation of FIG. 2), the jaws are closed; extension of the shaft 80 to the phantom line position pivots the arms 74, 76 forwardly, to open the jaws and release the bag. It will be noted that the arm 74 is connected to the lower jaw 66 through a linking arm 75, as is necessary to accommodate movement of the parts about the fixed pivot point of the shaft 60.

Figure 3:
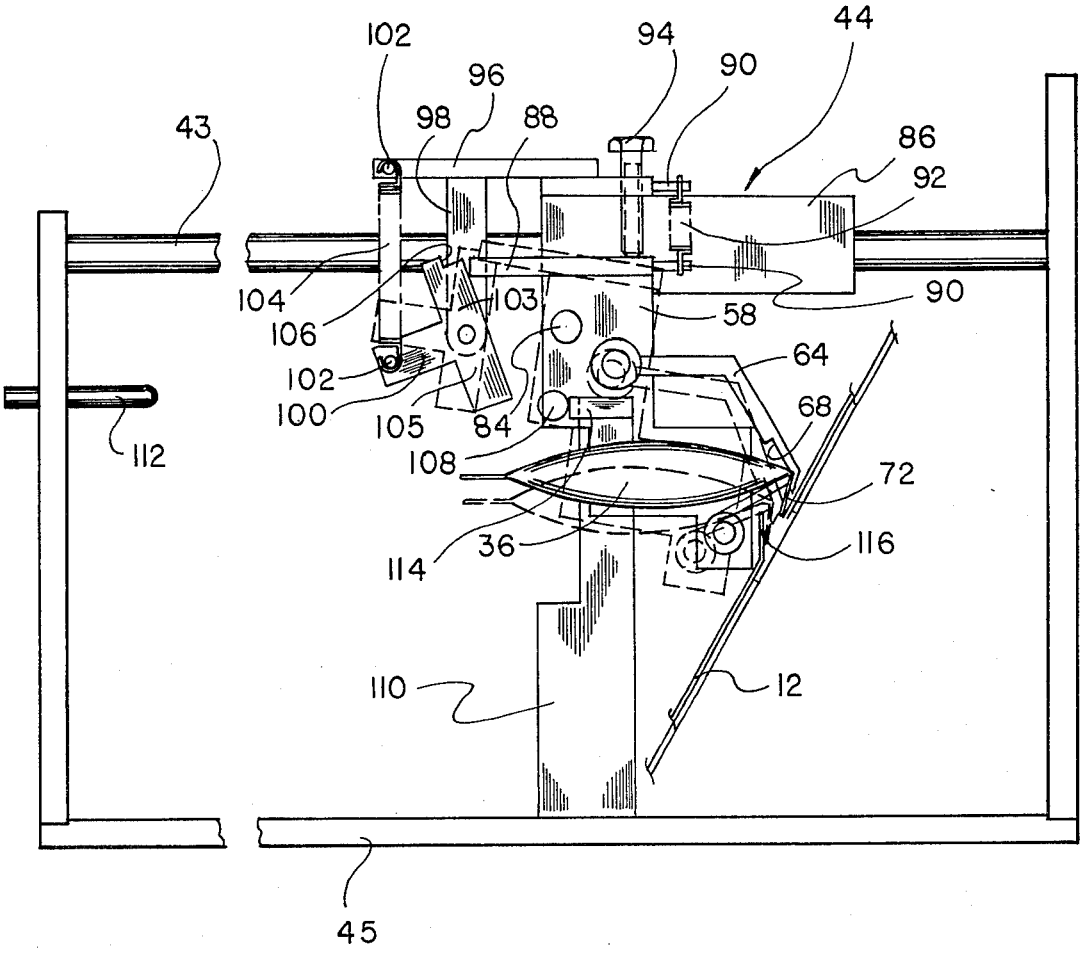
FIG. 3 is a fragmentary schematic representation showing operation of the carriage to load a product bag onto a display card, the pre-insertion and inserted positions being illustrated in full and phantom line, respectively.

In further description of the carriage assembly 44, FIG. 3 depicts the manner in which it is shifted or tilted downwardly at the point of loading, adjacent the card 12. As can be seen, the side plates 58 also carry a pivot axle 84, by which they are supported on the body 86 which, in turn, slides on the bars 43. They also carry a top plate 88, which has a post 90 on its forward end, to which one end of a coil spring 92 is attached, the opposite end being connected to a similar post 90 on the slider body 86, to thereby bias the carriage subassembly (i.e., the tiltable parts) upwardly. The slider body 86 carries a bolt 94, which serves as a stop against which the top plate 88 bears under the force of the spring 92, and it has a rearwardly extending bar 96 from which depends a supporting post 98 which, in turn, mounts on its lower end a T-shaped latch 100. The stem of the latch 100 and the outer end of the bar 96 have small, laterally projecting pins 102 thereon, about which a second coil spring 104 is attached; this causes the latch 100 to be biased in a clockwise direction. As can be seen, the upper element of the latch 100 is notched at 106 to provide a seat for the rearward end portion of the top plate 88 of the carriage subassembly. The latter also carries a pin 108 on one of the side plates 58, disposed to interfere with the stop block 114, which is supported on the stand 110 mounted, in turn, on the frame 45. Also mounted thereon is a contact pin 112, which is disposed to engage the lower element 105 of the T-latch 100, as will be described.

In the full-line representation of FIG. 3, the carriage 44 has been moved to the fully extended position, preparatory to the insertion of the bag flange 72 into the card 12. Upon encountering the stop block 114, the pin 108 restrains forward movement of the tiltable carrier despite the slight amount of further travel that occurs in the slider body 86. This, of course, deflects the subassembly downwardly on the axle 84 against the force of the coil spring 92, in turn effecting insertion of the flange 72 into the slot behind the tab 116 of the card 12. With the carriage subassembly so tipped, the latch 100 is freed to pivot in a clockwise direction under the force of the coil spring 104, causing the end of the upper plate 88 to seat within the notch 106 in the upper element 10 thereof, thus maintaining the tipped attitude of the carriage subassembly while the necessary operations are performed to lock the bag in position upon the card. Thereafter, the solenoid 82 (shown in FIG. 2) opens the jaws 64, 66, thereby releasing the bag 36 and permitting withdrawal of the carriage 44 toward the infeed conveyor belts 38, to pick up the next bag to be loaded. Upon approaching the fully withdrawn position, the contact pin 112 engages the lower element 105 of the latch 100, releasing the seated end of the plate 88 and permitting the spring 92 to return the carriage subassembly to its upwardly disposed, normal condition.

Figure 4:
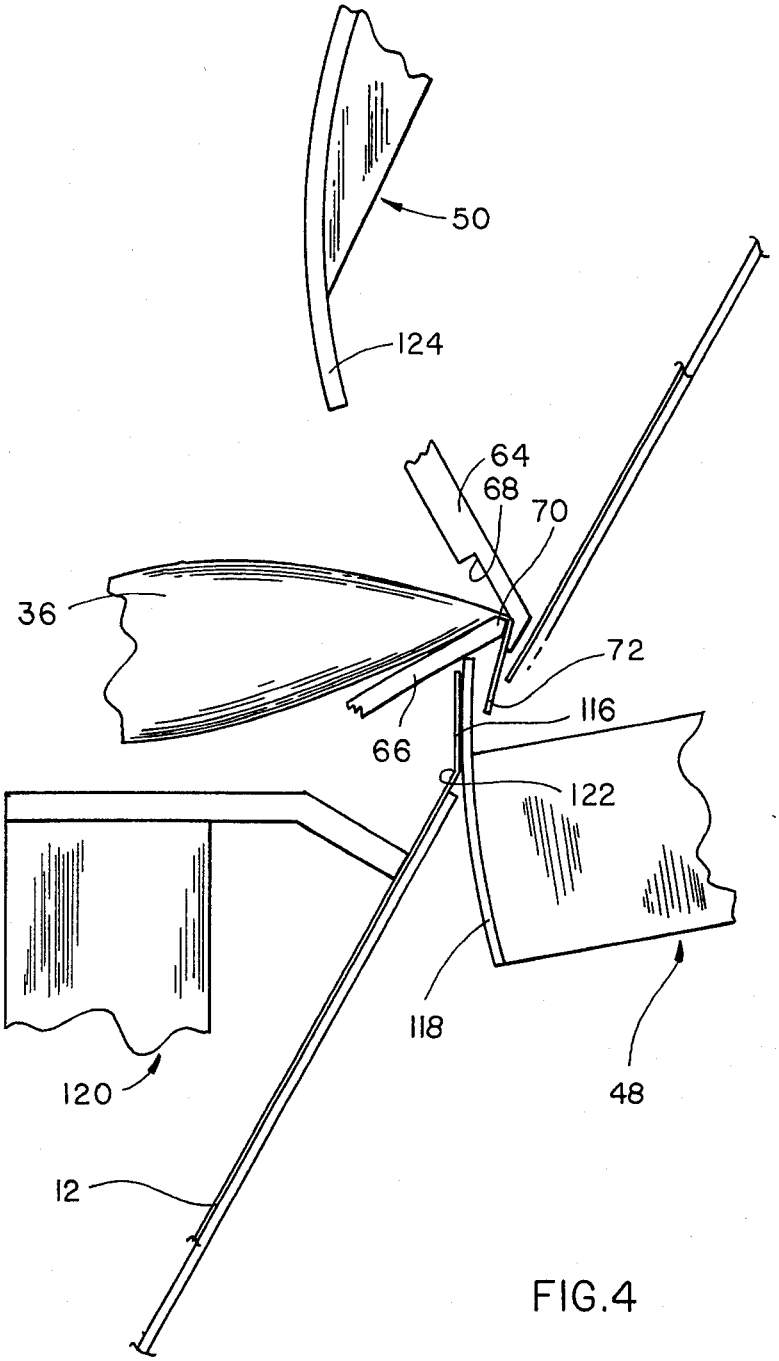
FIG. 4 is a fragmentary schematic view, to an enlarged scale, showing the positions of the several card manipulating members, at the point of initial insertion of the bag.
Figure 5:
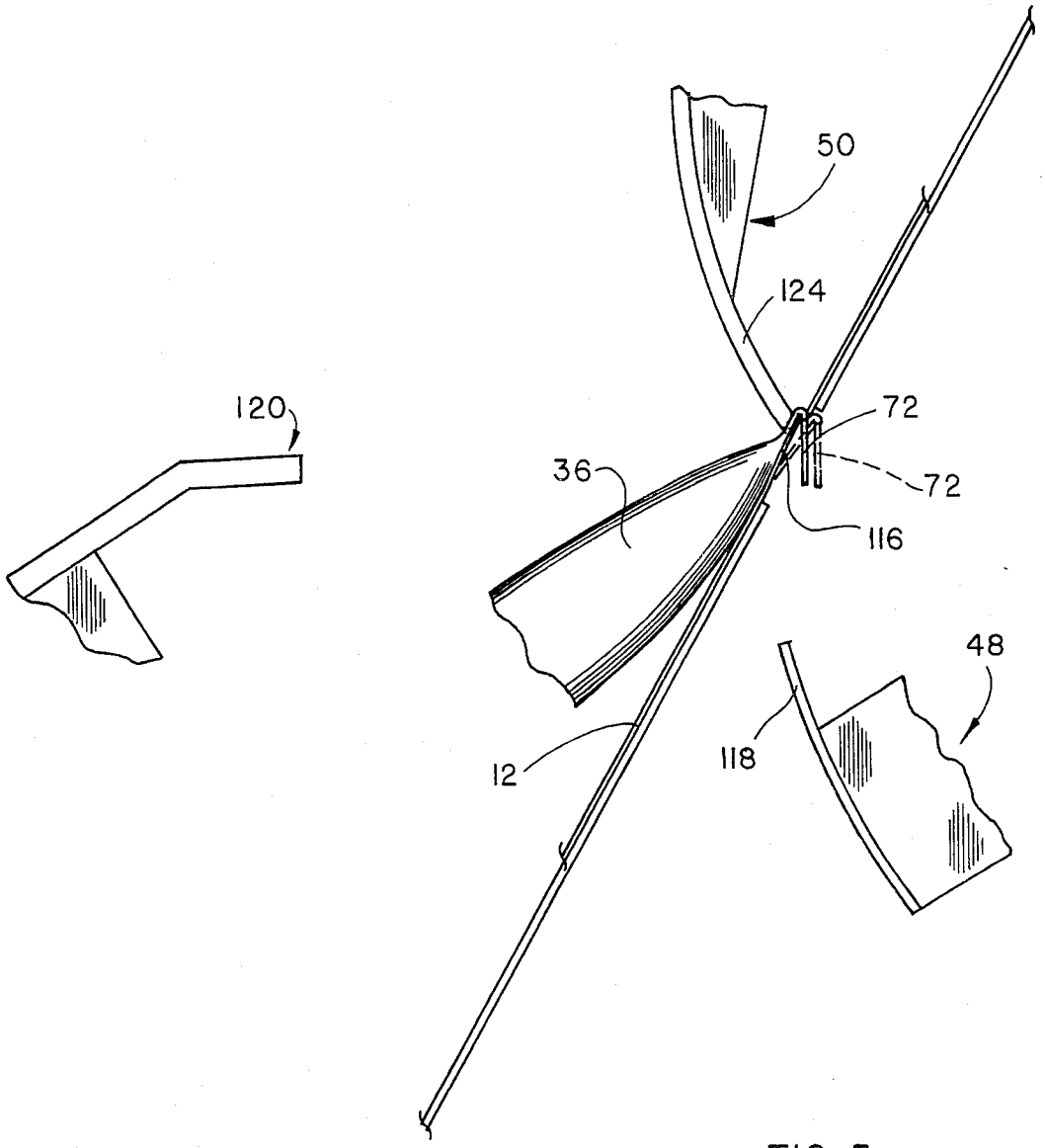
FIG. 5 is a similar view, but with the elements disposed as they would be during the final phases of the locking operation, the bag position being shown in full and phantom line immediately before final engagement, and subsequent thereto, respectively.

The sequence of operations involved in opening the slot behind the tab 116 of the card 12, and for locking the bag 36 therein, will now be described, with particular reference to FIGS. 4 and 5. As can be seen in FIG. 4, the curved portion or blade 118 of the pivotably mounted displacing member 48 has contacted the rear surface of the tab 116 and forced it out of the plane of the card 12 to a forwardly displaced position. This opens a slot behind the tab 116, into which the depending flange 72 of the bag 36 can be inserted, upon tilting of the carriage subassembly in its position proximate the card, as previously described. It should be noted that the blade 118 effectively functions as a guide for the flange 72, ensuring against interference and malfunction.

At about the time that the blade 18 attains the position depicted in FIG. 4, the pinning member, generally designated by the numeral 120, is brought to bear upon the forward face of the card at a point below the hinge portion 122, by which the tab 116 is connected thereto. Hence, the pinning member 120 assists the blade 118 in opening the slot and in maintaining the tab 116 in its displaced disposition; the mounting means for the pinning member 120 is not shown, but suitable structure will be evident to those skilled in the art, as will be means for driving the member 120, from a cam wheel of the bank 22 thereof, such as through appropriate connections with lever arms and tie rods of the sort shown with respect to the other pivotable members.

Subsequent to attainment of the positions illustrated in FIG. 4, the staking member 50 is pivoted in a downward arc, to bring its blade 124 into contact with the bag 36 at a point directly adjacent the crease line for the flange 72, near the free upper edge of the tab 116. This is done before the other tab and bag positioning members have been withdrawn, and is accomplished by configuring the staking blade 124 and the upper jaw 64 to avoid interference with one another. Upon attaining the positions shown in FIG. 5, the carriage 44 and the displacing and pinning members 48, 120 are withdrawn, with the staking member 50 alone holding the bag 36 in position. The staking member 50 then moves through the plane of the card 12, thereby forcing the folded portion of the bag 36 and the tab 116 rearwardly therebehind, as shown in phantom line. This produces an interference fit between the tab and the edge of the adjacent section of the card, thus securely attaching the bag 36 to the card 12, whereupon the staking member 50 can be withdrawn.

Subsequently, the conveyor 14 will be actuated to index the card to the next position at which a vacant slot is presented, to be acted upon by the illustrated parts of the mechanism for mounting of another bag thereinto. The cycle continues until the card is fully loaded, after which the next card will be fed to the starting position on the tracks, to ultimately receive its full complement of product bags. Although not shown, it will be appreciated that the mechanism will normally be designed to arrange a multiplicity of bags in several columns on the card, three across being typical but by no means the only possibility. Generally, on the fully loaded card, the bags will be disposed in shingled rows, eight to ten such rows being fairly standard.

An integrated system incorporating the mechanism of the invention may have additional features, such as means for automatically feeding the bags of product to the infeed arrangement 38, means for removing the loaded cards and the like. Control means will also desirably be included, both to sense that conditions appropriate to permit initiation of the various functions exist, and also to ensure that the several parts operate in proper timed sequence. For example, optical sensing devices will advantageously be provided to determine the presence of the correct number of bags on the infeed conveyor 38, prior to actuation of the gripping mechanism of the carrier 44; when the bags are loaded simultaneously into several columns (e.g., three across), such sensing will be particularly important, to ensure that all of the bags that are to constitute a row are in position before the action of the carrier commences. Insofar as timing is concerned, it will be readily appreciated that all of the functions described must take place in proper sequence, as can be achieved using a single prime mover with suitable cam wheels and indexing devices (as shown), or by using independent motors, automatically controlled.

In more specific terms, the timing must be such that the operation of the mechanism will commence with the loading of a card from the magazine 16 by the suction device 18. That having been accomplished, the indexing unit 32 must then carry the card 12 to the initial loading position, after which the blade of the displacing member 48 and the pinning member 120 must be operated to displace the tab 116 and open the slot therebehind. Generally, while this is occurring, the carriage 44 will have gripped one or more bags 36 and carried it to the loading position adjacent the card. Upon arrival, the carriage subassembly will tip downwardly, effecting insertion of the bag flange 72, after which the staking member 50 may be brought into play, to hold the bag in position while the other members are withdrawn. Finally, the staking member will force the bag and tab through the plane of the card, and will then withdraw to permit the card to be indexed to the next loading position.

It is of particular importance to note that, while it is transported in the carriage 44 the bag 36 droops or hangs at an angle substantially below horizontal. This promotes movement of the contents of the bag away from the flange 72, thereby clearing the upper regions, thus facilitating insertion of the flange and ensuring that the bag will ultimately be engaged securely on the card. As will be evident, the presence of product adjacent the flange would be most undersirable, in that it would tend to inhibit insertion, free movement of the tab to the locked position, and effective engagement of the bag. Although not illustrated, it will be especially desirable to augment the settling effect by suitable design of the infeed mechanism, such as will subject the contents to compacting forces or gravitational effects.

Thus, it can be seen that the present invention provides a novel mechanism by which product bags can be mounted automatically upon a display card, rapidly and in a highly effective and reliable manner. The bags may be disposed in a multiple column and row pattern, if so desired, and each bag may be so disposed, prior to the loading operation, as to promote movement of its contents away from the flange to be engaged by the card, thereby contributing substantially to the level of support ultimately provided and to the effectiveness and facility of loading. The mechanism is of relatively uncomplicated design, and is especially well-adapted for use in an integrated packaging system. The invention also provides a novel method for the mounting of product bags upon a display card, which method is rapid, facile, highly effective, and reliable.

Having thus described the invention, what is claimed is:

1. In a mechanism for mounting end-flanged bags upon a display card, the latter having a locking tab arrangement comprised of at least one lower locking tab that is displaceable from the plane of the card about a lower hinge portion thereof, and that has an upper edge portion configured to cooperate with a lower edge portion of an adjacent card section to engage the bag flange therebetween, the combination comprising: (a) means for supporting the card in a generally upright position; (b) displacing means for pivoting said tab about said hinge portion to displace it from said plane outwardly of the forward face of the card; (c) means for carrying the bag to a location adjacent the forward face of the supported card with the bag in a generally horizontal position, said carrying means having associated means for gripping the bag with the flange thereof folded downwardly, and being supported for movement at said adjacent location to effect insertion of the flange into the slot formed behind the displaced tab; and (d) return means for forcing the tab, with the folded portion of the bag carried thereupon, back through the plane of the card to partially dispose the folded bag portion therebehind and thereby engage the bag thereon.

2. The mechanism of claim 1 wherein said card supporting means includes a conveyor having engagement members thereon for holding the card in a fixed position relative thereto.

3. The mechanism of claim 2 additionally including drive means for said conveyor, said drive means being adapted for actuation to index the card to a multiplicity of positions relative to said carrying means, said tab displacing means, and said return means, to position the card for the insertion of a multiplicity of bags to be arranged as a column thereon.

4. The mechanism of claim 1 wherein said supporting means includes track structure to provide lateral edge support for the card.

5. The mechanism of claim 1 wherein said displacing means comprises a blade member disposed to contact the tab on the rearward face of the card.

6. The mechanism of claim 5 wherein said blade member is mounted for pivotable movement in an arc extending through the plane of the card, and wherein said mechanism additionally includes drive means for said blade member adapted for actuation to first pivot said blade member upwardly through said arc initially into contact with the rearward surface of the tab adjacent the hinge portion thereof, then through the card plane to force the tab to a forwardly displaced position and to define a flange insertion slot therebehind, and thereafter downwardly to withdraw said blade member from the slot so defined.

7. The mechanism of claim 5 wherein said blade member includes a curved contact portion.

8. The mechanism of claim 1 wherein said return means comprises a staking member disposed to contact the tab on the forward face of the card.

9. The mechanism of claim 8 wherein said staking member is mounted for pivotable movement in an arc extending through the plane of the card, and wherein said mechanism additionally includes drive means for said staking member adapted for actuation to pivot said staking member to an initial position adjacent the upper edge portion of the tab, at which it can contact the folded portion of the bag carried thereon, then to move through the plane of the card, and thereafter to withdraw therefrom.

10. The mechanism of claim 9 wherein said drive means for said staking member is adapted to cause said staking member to dwell in said initial position.

11. The mechanism of claim 9 wherein said staking member moves downwardly through said arc to said initial position thereof.

12. The mechanism of claim 1 wherein said carrier means includes a carriage mounted for reciprocal movement along a generally horizontal path to and from said card-adjacent location thereof.

13. The mechanism of claim 12 wherein said carriage is supported for downward tipping at said forward location to effect such flange insertion, and wherein said mechanism additionally includes means for so tipping said carriage.

14. The mechanism of claim 12 wherein said carriage has said gripping means thereon, said gripping means being contoured to deform the flange of the bag upon engagement therewith to produce the downwardly folded condition thereof.

15. The mechanism of claim 14 wherein said gripping means supports the bag with the main body portion thereof hanging at such an angle to horizontal as to promote movement of the contents away from the flange of the bag that is to be inserted into the card.

16. The mechanism of claim 12 additionally including conveyor means for delivering the bag to said carriage in a generally horizontal attitude, and means for shuttling said carriage along said path between said conveyor means and said card-adjacent location.

17. The mechanism of claim 6 additionally including a pinning member disposed to contact the card at a location on the forward face thereof below the hinge portion of the tab, and drive means adapted to move said pinning member between the contact position thereof and a position withdrawn therefrom, said drive means also being adapted to move said pinning member in timed relationship to the movement of said blade member to assist in establishing and maintaining the displaced position of the tab.

18. The mechanism of claim 1 additionally including means for furnishing a multiplicity of display cards to said supporting means, said furnishing means including a hopper for the containment of a stack of such cards, and means for withdrawing the cards therefrom individually and for delivering them, seriatim, to said supporting means.

19. In a method for mounting end-flanged bags upon a display card, the latter having a locking tab arrangement comprised of at least one lower locking tab that is displaceable from the plane of the card about a lower hinge portion thereof, and that has an upper edge portion configured to cooperate with a lower edge portion of an adjacent card section to engage the bag flange therebetween, the steps comprising: (1) disposing such a card in a generally upright position; (2) displacing the tab forwardly from the plane of the card about its hinge portion to form a slot therebehind; (3) carrying such a bag to a position proximate the forward face of said card with the main body portion of the bag in a generally horizontal position and with the flange thereof folded downwardly; (4) moving said bag to insert said flange into said slot behind said tab; and (5) forcing said tab, with the folded portion of said bag carried thereupon, back through the plane of said card to partially dispose the folded bag portion therebehind and thereby engage the bag thereon.

20. The method of claim 19 effected automatically and in timed sequence, wherein the tab arrangement of said card comprises a multiplicity of said locking tabs disposed in a column thereon, and wherein said card is indexed to a multiplicity of positions in stepwise fashion, for inserting a bag behind each of said tabs to mount a multiplicity of such bags in a column thereon, each of said tabs being so displaced and returned in sequence, and said bags being so carried individually to said position and so moved for insertion of the flange thereof behind the one of said tabs to which it is presented.

21. The method of claim 20 wherein said tab arrangement comprises a multiplicity of pairs of said locking tabs, the two tabs of each of said pairs being displaced and returned simultaneously, to cooperatively grip the flange of a single bag to so engage it on said card.

22. The method of claim 19 including the additional step of downwardly folding the flange of the bag.

23. The method of claim 22 wherein said folding step is effected substantially at the commencement of said carrying step.

24. The method of claim 19 wherein said carrying step is performed with said bag suspended from said flange, and with said main body portion thereof hanging downwardly to promote movement of the contents away from said flange.

25. The method of claim 24 wherein said insertion step is effected with a downward tilting movement of said bag.

* * * * *